United States Patent [19]

Kim

[11] Patent Number: 4,724,104

[45] Date of Patent: Feb. 9, 1988

[54] HUMIDIFIER PROVIDED WITH A PURIFIER

[75] Inventor: Hyung K. Kim, Kyungsangnam, Rep. of Korea

[73] Assignee: Gold Star Co., Ltd., Seoul, Rep. of Korea

[21] Appl. No.: 19,119

[22] Filed: Feb. 26, 1987

[30] Foreign Application Priority Data

Feb. 27, 1986 [KR] Rep. of Korea ..... 2314/1986[U]

[51] Int. Cl.[4] ..... B01F 3/04

[52] U.S. Cl. ..... 261/4; 261/6; 261/81; 261/DIG. 48; 210/282; 210/287

[58] Field of Search ..... 261/DIG. 48, 81, 4–6; 210/282, 287, 289

[56] References Cited

U.S. PATENT DOCUMENTS

| | | | |
|---|---|---|---|
| 2,886,057 | 5/1959 | Dolza et al. | 261/5 |
| 3,126,335 | 3/1964 | Stipe | 210/287 |
| 3,469,696 | 9/1969 | Petrucci et al. | 210/282 |
| 4,238,425 | 12/1980 | Matsuoka et al. | 261/DIG. 48 |
| 4,257,989 | 3/1981 | Nishikawa | 261/DIG. 48 |
| 4,631,152 | 12/1986 | Uchida et al. | 261/DIG. 48 |

*Primary Examiner*—Tim Miles

*Attorney, Agent, or Firm*—Birch, Stewart, Kolasch & Birch

[57] ABSTRACT

The present invention relates to a humidifier in which feed water is effectively fed into a purifier. The humidifier according to the invention comprises a ventilation tube through which the air between a valve body and the level of purified water in a humidifying cistern is outwardly ventilated, when the level of the purified water in the humidifying cistern is lowered below the valve body.

4 Claims, 3 Drawing Figures

HUMIDIFIER PROVIDED WITH A PURIFIER

BACKGROUND OF THE INVENTION

This invention relates to a humidifier provided with a purifier, more particularly to a humidifier which is able to improve the guality of feed water thereof and to smoothly provide humidity.

In conventional ultrasonic humidifiers used for controlling the humidity of room, the feed water introduced from a feed water tank into a humidifying cistern is vapourized in the humidifying cistern by an ultrasonic wave produced by means of a piezoelectric transducer, and then outwardly diffused through a diffusing nozzle of a nozzle case. The feed waters used for humidifiers are tap water, underground water, etc, in which a large amound of impurities and heavy metals such as Fe, Ca, Mg, etc may be contained.

However, in case such tap water or underground water is employed as it is in humidifiers, various inpurities included in these feed waters are deposited in the humidifier, and thus the function of the piezoelectric transducer deteriorates to shorten the life thereof. Also, the heavy metals spreaded in the air with the vapour cause white dust phenomenon on the walls, furniture, clothes, etc, and may cause respiratory trouble to perons.

To solve these problems, there have been proposed humidifiers in which a purifier is provided on a water inlet portion of a water tank or a humidifying cistern. However, these humidifiers involve many problems to be solved: the former requires too much times for storing water in the water tank, since feed water is introduced into the water tank through the purifier and the ventilation of the purifier is very poor; and the latter is prevented from smooth supply of purified water since the supply of purified water is not effective.

BRIEF SUMMARY OF THE INVENTION

It is therefore an object of the invention to provide a humidifier having no difficulties and problems as abovementioned.

It is another object of the invention to provide a humidifier in which a purifier is installed on an operating valve of a water tank and the supply of purified water from the purifier is effectively obtained.

To this end, the persent invention comprises a humidifier body., a water tank; a humidifying cistern; a nozzle case; a purifier; an engaging protrusion formed around an engaging opening of the bottom of the water tank and provided with a shoulder at its peripheral surface, the engaging protrusion having a threaded portion at its inner peripheral surface; a valve body provided with an annular flange having a threaded portion at its outer peripheral surface to detachably engage the inner threaded portion of the engaging protrusion; a ventilation tube upwardly extended from the center of an inner cylindrical body of the purifier, and a valve assembly consisting of an operating valve and a valve rod.

Figure 1:
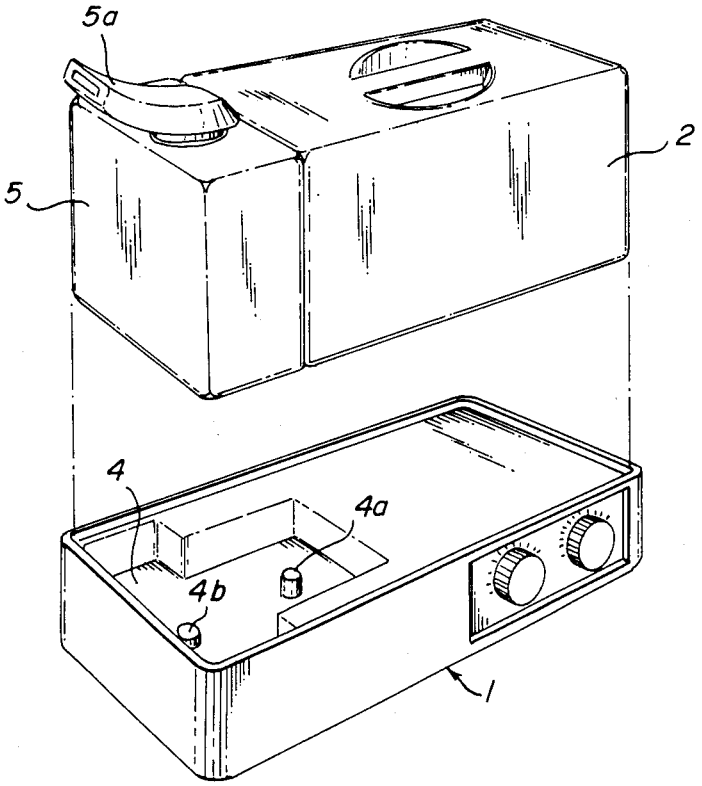
FIG. 1 PRIOR ART
Figure 2:
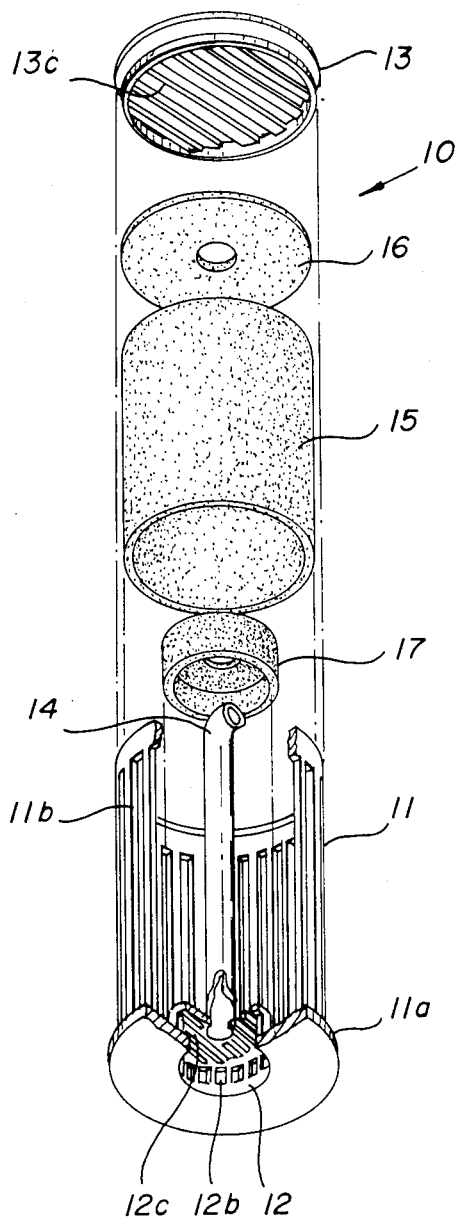
Figure 3:
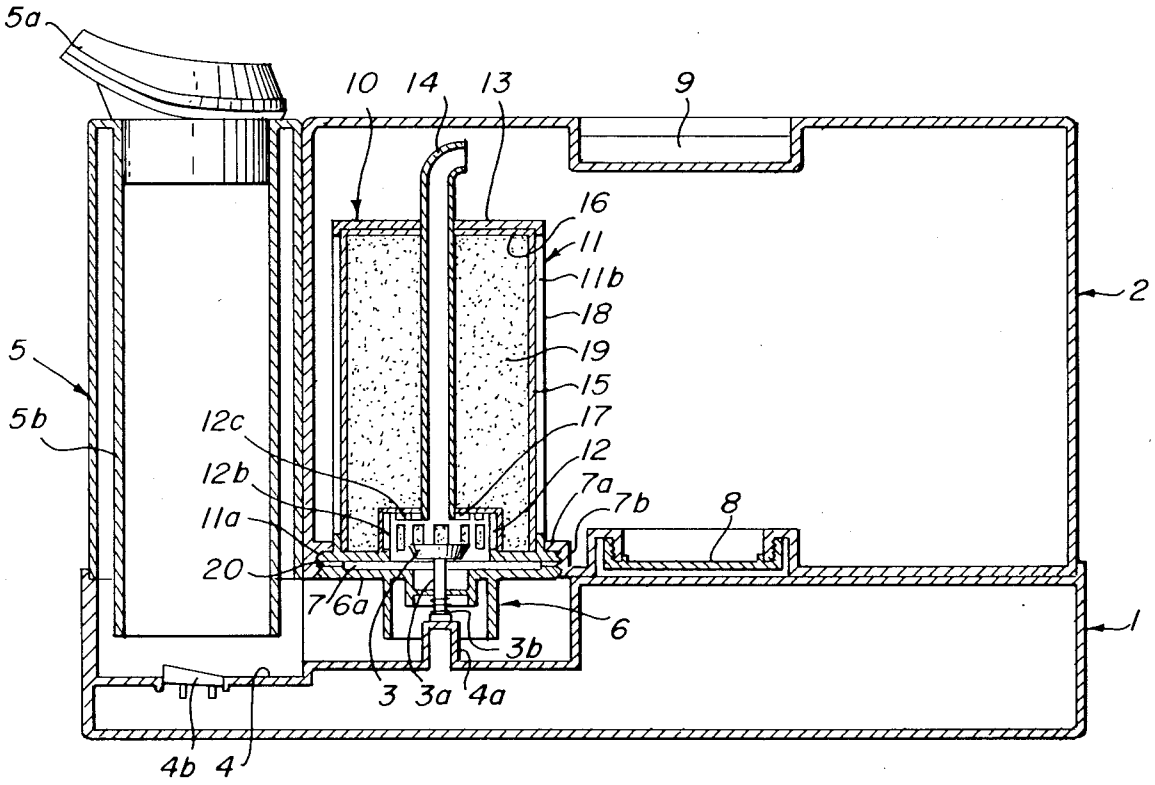

These above and other objects and advantages of the invention will become apparent from the following description taken in connection with the appended drawings, in which:

FIG. 1 is an exploded perspective view of a prior art to which the present invention pertains, FIG. 2 is an exploded perspective view of the purifier according to the present invention, and FIG. 3 is a longitudinal sectional view of the humidifier according to the invention in which the purifier of the invention is installed.

Referring now to FIG. 1, there is shown an example of a prior humidifier. As illustrated in the same FIG. 1, conventional humidifier comprises a humidifier body 1, a water tank 2 installed on the humidifier body 1, an operating valve 3 provided on the bottom of the water tank 2, a humidifying cistern 4 formed on a part of the humidifier body 1, a nozzle case 5 with vapourizing barrel 5*b* positioned on the humidifying cistern 4, a pushing protrusion 4*a* adapted to be contacted with the bottom of a valve rod 3*a* of the operating valve 3, and a piezoelectric transducer 4*b* for producing an ultrasonic wave.

Referring to FIG. 2, there is shown a preferred embodiment of the purifier according to the invention. Formed inwardly below an outer housing 11 is an inner cylindrical body 12 provided with a plurality of slots 11*b* and 12*b*, respectively, in predetermined widths at their peripheral surfaces. A cover plate 13 of the outer housing 11 and the upper surface of the inner cylindrical body 12 are also provided with a plurality of slots 13*c* and 12*c*, respectively, in predetermined widths. Thereby, the feed water contained in the water tank 2 is introduced into the purifier 10 through the slots 11*b* and 13*c* and the purified water from the purifier 10 flows into the humidifying cistern 4 through the slots 12*b* and 12*c*. Further, the purifier 10 according to the invention is provided with a ventilation tube 14, so that when the level of the purified water in the humidifying cistern 4 is below a valve body 6, the air between the valve body 6 and the level of the purified water in the cistern 4 is ventilated outwardly through the ventilation tube 14 and thus the feed water from the water tank 2 is smoothly fed into the purifier 10. Thereby, the purified water is effectively provided into the humidifying cistern. One end of the ventilation tube 14 is exposed in the air over the level of the feed water in the water tank 2. The purifier 10 is provided with filters 15, 16 and 17 therein which are contacted with inner faces of the housing 11 and cover plate 13 and the outer surface of the inner cylindrical body 12, respectively. Cation exchange resin 19 is filled in a purifying chamber 18 formed among the filters 15, 16 and 17.

Turning now to FIG. 3, there is shown a longitudinal sectional view of the humidifier of the invention provided with the purifier 10 according to the invention. A circular engaging opening 7 is formed on the bottom of the water tank 2 and provided with an engaging protrusion 7*b* having a shoulder 7*a* at its peripheral surface. The valve body 6 is provided with an annular flange 6*a* having a threaded portion at its outer peripheral surface, in order to detachably engage the engaging protrusion 7*b* threaded on the inner surface. Thereby, the purifier 10 may be supported through the opening 7 by means of the valve body 6 and a packing 20. The shoulder 7*a* bears on a flange 11*a* of the housing 11.

The valve rod 3*a* of the operating valve 3 bears on the protrusion 4*a* of the cistern 4 to open the valve 3, and is provided with a spring 3*b* so that the valve 3 may be closed by the restoring force of the spring 3*b* when the water tank 2 is lifted up for refilling of feed water or repair purposes. Reference numeral 8 is a plug for plugging the feed water inlet portion through which feed water is introduced. Reference numerals 5*a* and 9 are a diffusing nozzle through which vapourized humidity is diffused and a knob of the water tank 2, respectively.

If after the feed water is filled into the water tank 2 through the feed water inlet portion the water tank 2 is set on the humidifier body 1, the valve rod 3*a* of the valve 3 is pushed against the protrusion 4*a* to open the valve 3. Thereby, the feed water contained in the water tank 2 is introduced into the purifier 10 through the slots 11*b* and 13*c* and the purified water from the purifier 10 may flow into the cistern 4 through the opened valve 3.

The feed water fed into the purifier 10 is primarily filtered through the filters 15 and 16, the various impurities contained therein is removed through the purifying chamber 18 filled with cation exchange resin 19 and then the water is secondarily filtered through the filter 17. Thereby, perfectly purified water may be introduced into the cistern 4 to eliminate the malfunction and life shortening of the piezoelectric transducer 4*b*. Furthermore, the purifier 10 of the invention is provided with the ventilation tube 14 so that the feed water is smoothly fed into the purifier 10 to effectively provide purified water.

As set forth hereinabove, the purifier of the invention not only provides a simple assemblage characteristic but also enhance the filtration efficiency thereof by providing an effective feeding of feed water thereinto.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A humidifier comprising a humidifier body, a water tank, a humidifying cistern, a nozzle case, a purifier characterized by;

an engaging protrusion formed around an engaging opening of the bottom of said water tank and provided with a shoulder at its peripheral surface, said engaging protrusion having a threaded portion at its inner peripheral surface;

a valve body provided with an annular flange having a threaded portion at its outer peripheral surface to detachably engage the inner threaded portion of said engaging protrusion;

a ventilation tube upwardly extended from the center of an inner cylindrical body of said purifier; and a valve assembly consisting of an operating valve and a valve rod.

2. A humidifier as set forth in claim 1, wherein the free end of said ventilation tube is extended to be exposed in the air over the level of feed water contained in said water tank.

3. A humidifier as set forth in claim 1, wherein said humidifying cistern is provided with a pushing protrusion at its bottom for upwardly pushing said valve rod and opening said operating valve upon contact of said valve rod and said pushing protrusion.

4. A humidifier as set forth in claim 1, wherein said valve assembly is further provided with a spring to urge said operating valve into a closed position upon said valve rod being detached from said pushing protrusion of said water tank.

* * * * *